United States Patent [19]

Fisk

[11] Patent Number: 4,723,634

[45] Date of Patent: Feb. 9, 1988

[54] RAPPELLING DEVICE

[76] Inventor: Brian K. Fisk, 7933 S.E. 15th Ave., Portland, Oreg. 97202

[21] Appl. No.: 919,980

[22] Filed: Oct. 17, 1986

Related U.S. Application Data

[63] Continuation of Ser. No. 860,693, May 2, 1986, abandoned, which is a continuation of Ser. No. 671,700, Nov. 15, 1984, abandoned.

[51] Int. Cl.[4] ..... B65H 59/14

[52] U.S. Cl. ..... 188/65.4; 182/5

[58] Field of Search ..... 188/65.1, 65.4; 182/5, 182/6, 7, 8, 9, 72, 193

[56] References Cited

U.S. PATENT DOCUMENTS

| | | | |
|---|---|---|---|
| 316,870 | 4/1885 | Braunfeld | 188/65.4 |
| 682,082 | 9/1901 | Ives | 182/7 |
| 785,019 | 3/1905 | Parker | 188/65.4 |
| 1,852,887 | 4/1932 | Lossius | 182/7 X |
| 3,717,219 | 2/1973 | Hoffman | 188/65.4 X |
| 4,466,612 | 8/1984 | Marczewski | 188/65.1 X |

FOREIGN PATENT DOCUMENTS

| | | | |
|---|---|---|---|
| 114892 | 10/1876 | France | 188/65.4 |
| 1347677 | 2/1974 | United Kingdom | 182/5 |

*Primary Examiner*—George E. A. Halvosa

*Attorney, Agent, or Firm*—Chernoff, Vilhauer, McClung & Stenzel

[57] ABSTRACT

The present invention is comprised of three integral eyes joined end to end for receiving a doubled back segment of a line such that the line becomes wrapped around the device in a symmetrical manner to frictionally slow the rate of descent of the device, and a person attached to it, down the line without imparting any net twist to the line. The line can be attached to the device in several manners, all of which include passing the doubled back line segment through one or more of the eyes and then wrapping it around the device so that it cannot be pulled back through the eyes. In addition to being easily attached to the line intermediate its ends it attaches symmetrically to the line so that the line does not twist as it is played through the device. By turning the device upside down and attaching it to a fixed anchor it can be used to lower a load attached to one end of the line.

2 Claims, 11 Drawing Figures

RAPPELLING DEVICE

This application is a continuation of Ser. No. 860,693, filed May 2, 1986 which in turn is a continuation of Ser. No. 671,700, filed Nov. 15, 1984, both now abandoned.

BACKGROUND OF THE INVENTION

This invention relates to a rappelling device and in particular to such a device which does not have any moving parts and still can be attached to the middle of the line with which it is being used without causing any net twisting of the line.

Many devices are known for slowing the rate at which a person descends a line. In addition, many of these devices are arranged to allow them to be attached to the line at an intermediate point. Such devices are used in recreational activities and rescue work, such as in rock climbing, as well as for commercial endeavors, such as building maintenance and window washing.

The prior art devices of this type have two shortcomings, however, which limit their usefulness. First, such prior art devices are capable of being attached to the line at its center only by having moving parts which allow the devices to be opened to admit the line into them or to clamp onto the line. Not only does this increase the complexity of the device, which increases its cost, it makes it difficult to attach the device to the line since the user must close the movable elements and ensure that they are locked in the closed position before using it. This difficulty in attaching the device to the line increases the likelihood that the device will be dropped when it is being attached, as well as slowing down the attachment process. Furthermore, the existence of moving parts on the device makes the possibility of failure greater, which lessens the confidence of users in it.

Another shortcoming of the prior art rappelling devices is that the line generally is wrapped onto the device in one direction only. Thus the line tends to become twisted which makes it susceptible to damage when shock loading occurs and the line has increased fiber wear due to the torsional stress caused by the twisting.

SUMMARY OF THE INVENTION

The present invention overcomes the foregoing shortcomings and limitations of the prior art rappelling devices by providing two eyelets and a projection which are linearly interconnected such that a line can be wrapped onto the device symmetrically intermediate its ends without the device being openable or having any moving parts whatsoever and without imparting any net twist to the line. In the preferred embodiment the projection comprises a third eyelet which facilitates attachment of the device to a user.

The first and third eyelets, located at each end of the device, are smaller than the second eyelet located in the center. Thus a shoulder is formed between the second and third eyelets. A tang extends upwardly from the top of the first eyelet and a finger extends out from the side of the second eyelet. If desired, a line guide can be attached to the first eyelet on one side of the device. The line guide is attached to the first eyelet at one end and is separated from it on the other end by a distance which is slightly more than the width of the line.

The device normally is attached to a line by doubling a segment of the line over into a loop which is passed through the first eyelet. The loop then is wrapped around the device and passed through the second eyelet in the same direction that it was passed through the first eyelet. Finally, the loop is wrapped around the third eyelet which acts as a catch to prevent it from being pulled back through the device. The loop is engaged by the shoulder located between the second and third eyelets to prevent it from passing up around the second eyelet and thereby binding against itself. The user attaches himself to the rappelling device by securing a hook to the third eyelet. Once attached to the line in this manner the rappelling device serves to slow the rate at which the user descends the line due to the friction between the line and the device as the line is pulled through it.

Alternate methods of wrapping the line on the device will achieve relatively faster and slower rates of descents. In some of these methods the loop is wrapped around the second eyelet rather than the third and in this instance the finger acts to prevent the loop from passing up over the second eyelet.

Finally, the line can be locked immovably on the device, regardless of the particular method of wrapping, by looping the free downwardly extending portion of the line back up and around the device so that it passes between the catch and the upwardly extending portion of the line and thus becomes wedged therebetween.

The device also can be used to lower a load by turning it upside down and attaching the third eyelet to a fixed anchor. The device is wrapped in the same manner as above, however, one end of the line is attached to the load and the line is then played through the device in order to lower the load. As above, the friction between the device and the line serves as a brake to slow the rate at which the load descends.

Regardless of whether the device is used for rappelling or for lowering a load, and regardless of the particular method used to wrap the line onto the device, the device can be attached to the middle of the line merely by doubling the line over, passing it through one or more of the eyelets and then wrapping it around the device to prevent it from being pulled back through. Thus, the attachment is quick and positive so that there is little likelihood that the device will be dropped while it is being attached or that it inadvertently will become disengaged once it has been attached. In addition, since the line is wrapped symmetrically onto the device, it does not twist when it is drawn through the device and thereby become tangled or unraveled.

Accordingly, it is a principal object of the present invention to provide a rappelling device which can be attached to a line intermediate its ends quickly and easily.

It is a further object of the present invention to provide such a device which is one piece and which can be attached to a line without the necessity of any moving parts.

It is a further object of the present invention to provide such a device which permits the line to be wrapped symmetrically in order to prevent twisting of the line.

It is a still further object of the present invention to provide such a device which is simple and inexpensive to construct.

It is a further object of the present invention to provide a method for wrapping a line onto such a device intermediate its ends.

It is a still further object of the present invention to provide such a method where the line is wrapped symmetrically so that it does not twist when played through the device.

The foregoing objectives, features and advantages of the present invention will be more readily understood upon consideration of the following detailed description of the invention taken in conjunction with the accompanying drawings.

DETAILED DESCRIPTION OF A PREFERRED EMBODIMENT

Figure 1:
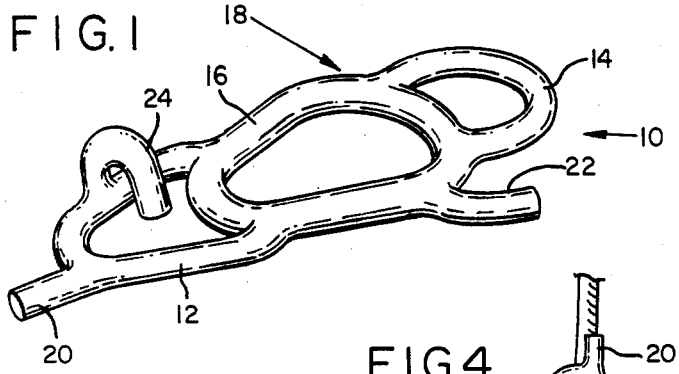
FIG. 1 is a perspective view of a rappelling hook embodying the features of the present invention.
Figure 2:
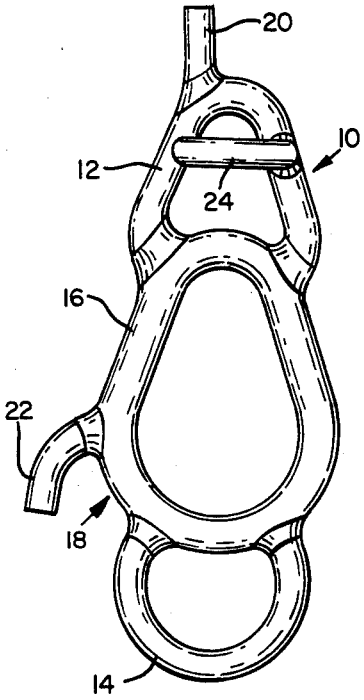
FIG. 2 is a plan view of the rappelling hook of FIG. 1.
Figure 4:
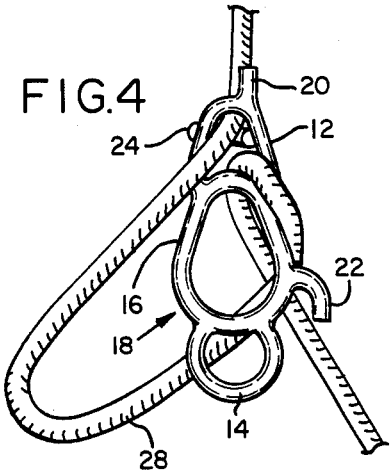
FIGS. 3–6 are plan views of the rappelling hook showing the sequence upon which a line typically is attached to it.
Figure 3:
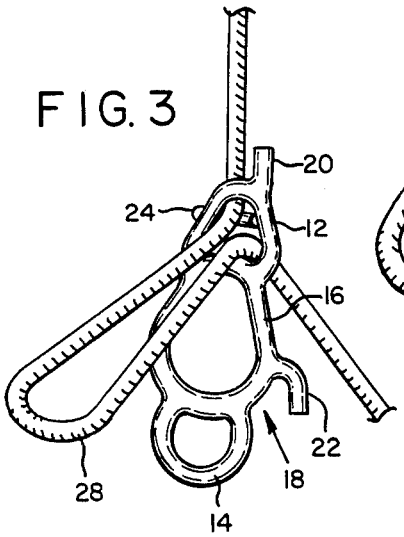
Figure 5:
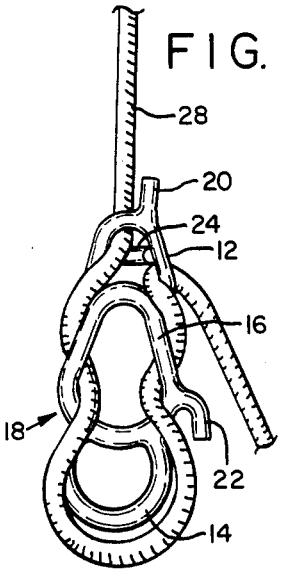

Referring to FIGS. 1 and 2 of the drawings, the present invention comprises a rappelling device 10 which has two eyelets which are connected to one another. The first eyelet 12, which normally is at the top of the device, is smaller than the second eyelet 16 which forms the body of the device. The second eyelet is tapered from the bottom to top, however, so that at its point of joinder with the first eyelet they have approximately the same width. As will be more fully explained later, the first and second eyelets receive a doubled-over segment of line through them, and, therefore, must be large enough to receive two turns of the line. Attached to the second eyelet 16 at a location opposite the location where the first eyelet is attached to the second eyelet is a projection 14 around which a line that has been doubled over and passed through the first and second eyelets can be wrapped to prevent it from being pulled back through the first and second eyelets. In the embodiment illustrated the projection is a third eyelet in order to provide a point for attaching the device to the user. However, it could have other shapes so long as it is narrower than the second eyelet at their point of attachment so that a shoulder 18 is formed therebetween. In fact, the projection 14 does not even have to be integral with the second eyelet and a carabiner (not shown) which is used to attach the device to a user could serve this purpose.

Extending upwardly from the top of the first eyelet 12 is a tang 20 which is straight and preferably is approximately one inch long. Extending sideways from the middle of the second eyelet is a finger 22 which curves downwardly toward the third eyelet. In addition, the device may include a line guide 24 which is joined to one side of the first eyelet and extends rearwardly from the device and curves back toward the other side of the first eyelet terminating slightly more than one line width from it.

In order to minimize wear of the lines used with the device, its various elements preferably are round in cross section. While the individual elements are shown as being joined together by welding in the embodiment illustrated, the device also can be integrally formed by forging or by casting.

FIGS. 3–6 illustrate the sequence of a preferred manner of wrapping a line onto the device. Starting with FIG. 3, the line 26 first is doubled over intermediate its ends to form a loop 28 which is passed through the first eyelet 12 from back to front. After the loop is passed through the first eyelet it is wrapped around the device, FIG. 4, and is passed through the second eyelet in the same direction as it was passed through the first eyelet, FIG. 5. The loop then is wrapped around the third eyelet 14 which acts as a catch to prevent it from being pulled back through the first and second eyelets. The shoulder 18 formed between the second and third eyelets prevents the loop from being pulled up over the second eyelet where it could become jammed against itself and bind. The device also can be attached to the extremity of a line by passing the end of the line through the device in a manner which provides the same pattern in the line as is provided by the above-described method of wrapping.

When wrapped in this manner the line passes through the first eyelet 12 on one side of the device and then wraps around the outer surface of the device at the point of joinder of the first eyelet 12 to the second eyelet 16. The line then passes through the second eyelet and is wrapped around the circumference of the second eyelet and back behind the third eyelet 14. Thus, a spiral pattern is formed in the line as it extends down the first side of the device. Since the spiral is formed by the line passing into, out of and behind the separate eyelets, it cannot close up onto itself and thus the line cannot come into contact with itself at any time.

After the line passes behind the third eyelet it winds back up the other side of the device by passing back into and then out of the second eyelet. The line then wraps around the outer surface of the point of joinder of the first and second eyelets and back through the first eyelet. Thus, the spiral formed on the second side of the device is a mirror image of the spiral formed on the first side. As a result, any twist which is imparted in the line in the first spiral is taken back out in the second spiral and no net twist is created in the line. Once attached to the rappelling device in this manner the line can still be played linearly through the device but it will encounter considerable resistance while doing so and thus it acts as a brake to slow the descent of someone who is attached to the device. While not shown, attachment to the device is through conventionally known means, such as a snap hook, to the third eyelet 14.

Figure 7:
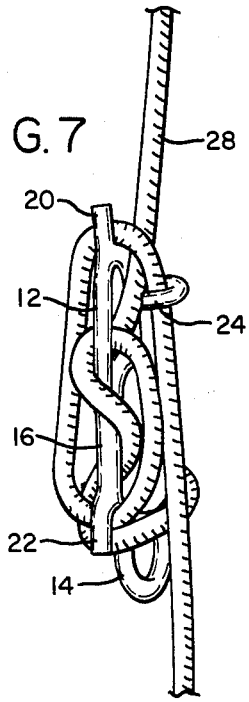
FIG. 7 is a side elevational view showing the line in a locked configuration on the device.

If desired, the line can easily be locked to prevent it from being played through the device by wrapping the portion of the line which extends below the device, and thus is not under tension, around the finger 22, upwardly between the tang 20 and the portion of the line extending upwardly from the device, and then back down behind the device, as shown in FIG. 7. The tang causes the wrapped portion of the line and the upwardly extending portion of the line to be wedged together where relative movement between them is prevented. In the embodiment illustrated the wrapped portion of the line is placed behind the line guide 24 to prevent it from accidentally being pulled out of the locked configuration, however, this is not necessary. An even more permanent lock can be obtained by forming multiple loops in the line around the tang and the finger.

In addition to serving to lock the line on the device, wrapping the line around the finger 22 and the tang 20 can be used to increase the friction imparted by the device when rappelling. This additional friction can be reduced merely by pulling the line outwardly from the device, to pull it free of the tang 20, and then put back in again by pulling the line back down over the tang. This procedure works particularly well when rappelling a small diameter line, and permits using the device on lines which otherwise would be too small for the device.

The above-described manner of wrapping the device is utilized for normal rates of descent, however, the line can be wrapped in other manners if desired to give faster or slower rates of descent. For example, in FIG. 8, after the loop 28 is passed through the first eyelet it is wrapped around the finger 22 and behind the second eyelet 16. Thus, the line is wrapped much more loosely than with the normal wrap and accordingly will play through the device much more freely. As a result the device has much less braking effect with this wrap than it has with the normal wrap.

Figure 6:
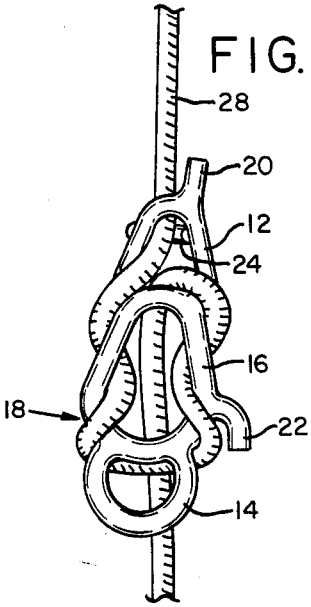
Figure 8:
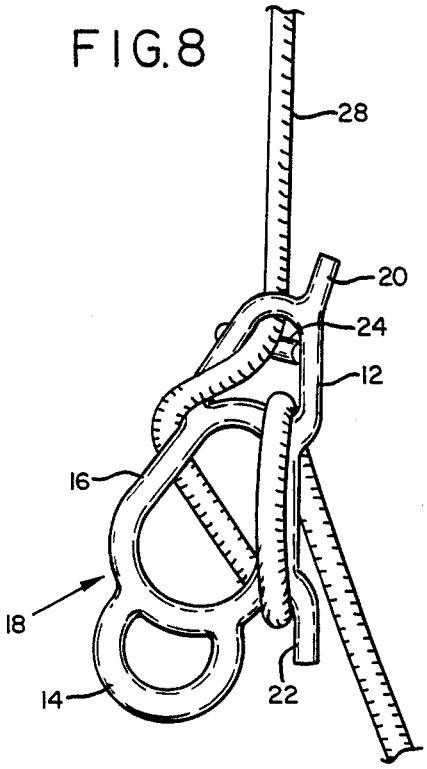
FIGS. 8–10 are plan views of the hook showing alternate ways in which the line can be wrapped thereon.
Figure 9:
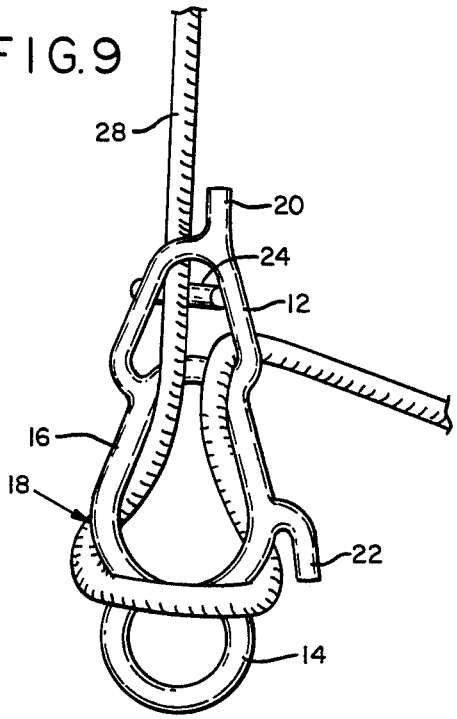

An intermediate wrap, shown in FIG. 9, provides a rate of descent between the fast descent wrap shown in FIG. 8 and the normal descent wrap shown in FIG. 6. In this configuration, after the loop 28 is passed through the first eyelet 12 it immediately is passed through the second eyelet 16 rather than first being wrapped behind the device as was done with the normal wrap. Thus, the loop passes through the two eyelets in opposite directions rather than in the same direction as with the normal wrap. The loop is then wrapped around the third eyelet to prevent it from being pulled back through the first and second eyelets.

Figure 10:
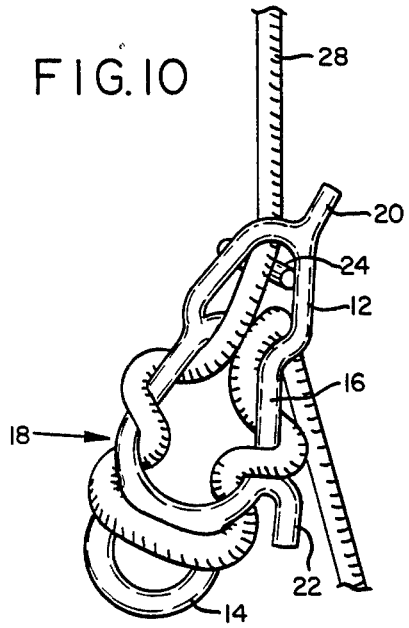

A final wrap, shown in FIG. 10, gives a rate of descent which is slower than is the case with the normal wrap. In this wrap, the loop is passed through the first and second eyelets in opposite directions, as with the wrap shown in FIG. 9. However, rather than then wrapping it around the third eyelet it first is wrapped around the second eyelet and passed back through it again in the opposite direction. Thus, the loop passes through the second eyelet twice before it is wrapped around the third eyelet.

Of course, other wraps too numerous to illustrate here are possible to achieve different rates of descent. As is the case with the normal wrap, the line can be locked with any of the wraps by wrapping its downwardly extending portion around the finger 22 and bringing it back up and around the tang 20. Also, with all of the wraps the line can be attached to the device by doubling it over intermediate its ends and passing the resulting loop through one or more of the eyelets. Thus, the device is attached to the line as an integral unit without the need to open any portion of it or the necessity to use clamps or other attachment devices.

Figure 11:
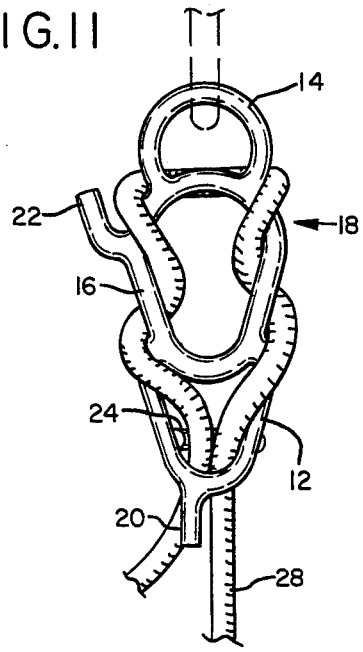
FIG. 11 is a plan view of the device turned upside down and attached to a fixed anchor, shown in dashed line, in order to lower a load.

In addition to being used for rappelling a line, the device can be used to lower a load by reversing it as shown in FIG. 11 and attaching the third eyelet to a fixed point where the load is to be lowered from. In this case the line is attached to the device in the manner described above except that it is done near one end of the line which is attached to the load. The load then is lowered by playing the line slowly through the device. Again the rate of descent depends on the manner in which the line is wrapped.

In addition to preventing the line from bunching up against itself and from becoming twisted the spiral induced in a line wrapped on the device of the present invention has several other benefits. While the spiral cannot close or expand beyond the limits imposed by the device, it can open and close to some degree. In fact, the spiral tends to open somewhat at higher descent rates of the device than it does at lower descent rates. This occurrence permits the user to descend at a high speed when desired but still have the ability to increase the drag quickly when it is desired to slow the rate of descent. This is because pulling downwardly on the free end of the line increases the friction which causes the descent to be slowed. This lower speed causes the spiral to close which further increases the friction. As a result, the device gives very good control of the braking action.

In addition, the spiral normally is tighter when the device is located near the top of the line being rappelled, due to the restraint on the line. Thus, all else being equal, there is greater braking action at the top of the line than near its bottom which provides a margin of safety.

Furthermore, most of the braking load is created in the area where the rope wraps around the point of joinder of the first and second eyelets the first time. Thus, most of the wear occurs at this point. As a result, if the device were to break, the break would occur at this location and the majority of the wrapping would remain to provide sufficient braking action.

Finally, the spiral loop created on the device causes the line to contact the device around substantially its entire circumference. Thus, long line life and better braking action is obtained.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A rappelling device, capable of receiving a line which is not part of the invention, comprising:

(a) a first eyelet large enough to receive at least two turns of line without one turn touching the other turn;

(b) a second eyelet in the same plane as said first eyelet and attached to said first eyelet in an area proximate its outer circumference providing opposing rounded outer surfaces of said area of attachment, said second eyelet being large enough to receive two turns of line without one turn touching the other turn; and (c) a projection having a third eyelet capable of receiving a load whose attachment to the projection will retain said rappelling device in proper alignment for use and prevent said line from slipping off of said projection, said projection attached to said second eyelet substantially coplanar with said first and second eyelets and substantially opposite from the area of attachment of said first eyelet to said second eyelet, providing opposing rounded outer surfaces of said second opposed area of attachment forming a shoulder that resists movement of said line up and around said second eyelet during use so that a line can be inserted through said first eyelet, wrapped around the rounded outer surface of the area of attachment of said first eyelet to said second eyelet, into said second eyelet and out and around the rounded outer surface of the area of attachment of said second eyelet to said projection, thence around said projection and back around the rounded outer surface of the area of attachment of said second eyelet to said projection into said second eyelet, and out and around the rounded outer surface of the area of attachment of said first eyelet to said second eyelet, and then reinserted into and passing through said first eyelet, so that said line forms a spiral shape as it passes between its insertion into said first eyelet and said projection and forms a mirror image of said spiral shape as it passes between said projection and its exit from said first eyelet so as to remove any twist placed in the line before reaching said projection.

2. The device of claim 1 including:

(a) a tang attached to said first eyelet substantially opposite from the area of attachment of said first eyelet to said second eyelet;

(b) a finger attached to said second eyelet proximate said projection; and (c) said tang and finger arranged such that the line can be wrapped around said finger and then around said tang after passing out of said first eyelet in order to increase the friction asserted on the line by the device.

* * * * *